United States Patent [19]

Brull et al.

[11] Patent Number: 4,632,577

[45] Date of Patent: Dec. 30, 1986

[54] RECORD MEDIA THICKNESS COMPENSATING MECHANISM

[75] Inventors: Robert A. Brull, Dryden; Alan H. Walker, Barton; William V. McFall, Dryden, all of N.Y.

[73] Assignee: NCR Corporation, Dayton, Ohio

[21] Appl. No.: 776,243

[22] Filed: Sep. 16, 1985

[51] Int. Cl.[4] ..... B41J 11/08

[52] U.S. Cl. ..... 400/56; 400/58; 400/649

[58] Field of Search ..... 400/56, 58, 649, 655, 400/656

[56] References Cited

U.S. PATENT DOCUMENTS

| | | | |
|---|---|---|---|
| 3,776,341 | 12/1973 | Dobner et al. | 400/57 |
| 3,837,461 | 9/1974 | Waibel | 400/56 |
| 3,868,008 | 2/1975 | Brumbaugh | 400/649 |
| 3,912,068 | 10/1975 | Kwan et al. | 400/595 |
| 3,935,936 | 2/1976 | Wilczewski | 400/55 |
| 3,995,730 | 12/1976 | Kwan et al. | 400/649 |
| 4,024,940 | 5/1977 | Hendrischk et al. | 400/56 |
| 4,056,183 | 11/1977 | Beery | 400/124 |
| 4,143,977 | 3/1979 | Kurihara et al. | 400/56 |
| 4,145,146 | 3/1979 | Ohkawara et al. | 400/614 |
| 4,184,780 | 1/1980 | Kurihara et al. | 400/56 |
| 4,210,076 | 7/1980 | Yamamoto et al. | 101/111 |
| 4,222,673 | 9/1980 | Plaza et al. | 400/56 |
| 4,227,819 | 10/1980 | Manriquez | 400/56 |
| 4,233,895 | 11/1980 | Wehler | 101/93.05 |
| 4,384,794 | 5/1983 | Okano et al. | 400/56 |
| 4,390,292 | 6/1983 | Krenz | 400/59 |
| 4,422,782 | 12/1983 | Lawter et al. | 400/56 |
| 4,439,051 | 3/1984 | Lawter | 400/605 |
| 4,514,101 | 4/1985 | Smith | 400/59 |

FOREIGN PATENT DOCUMENTS

| | | | |
|---|---|---|---|
| 109774 | 8/1981 | Japan | 400/58 |

OTHER PUBLICATIONS

Schall, "Self Lifting . . . Assembly", IBM Technical Disclosure Bulletin, vol. 23, No. 9, p. 4252, 2/81.

*Primary Examiner*—William Pieprz

*Attorney, Agent, or Firm*—Wilbert Hawk, Jr.; Albert L. Sessler, Jr.; George J. Muckenthaler

[57] ABSTRACT

A mechanism for compensating for different thicknesses of record media at a printing station utilizes a platen supporting or carrying assembly which is pivotable to move the platen toward the print head. Another supporting assembly, also pivotable, is provided to carry a record media drive roller and is interconnected with the platen supporting assembly by means of a pin and slot arrangement to effect a substantially equal gap at the platen-print head and at the pressure roller-drive roller. A first cam member is rotated to engage with and to swing the platen supporting assembly into printing position and a second cam member is connected with the first cam member and rotated thereby to maintain the assembly in printing position.

20 Claims, 2 Drawing Figures

RECORD MEDIA THICKNESS COMPENSATING MECHANISM

CROSS-REFERENCE TO RELATED APPLICATION

Record Media Thickness Compensating Mechanism, co-pending application Ser. No. 602,800, filed Apr. 23, 1984, now U.S. Pat. No. 4,575,267, issued Mar. 11, 1986, invented by Robert A. Brull and assigned to NCR Corporation.

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical derived system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like media while the carriage and print head are moved above and across the form or media in the horizontal direction.

Alternatively, the print head may be supported and guided along a line of printing wherein the form or record media is placed on edge and the print head is caused to be driven in a vertical direction for the printing operation.

Further, the printer structure may be an arrangement which includes a plurality of equally-spaced, horizontally-aligned, single element print heads which are caused to be moved in back and forth manner to print successive lines of dots in making up the lines of characters. In this latter arrangement, the drive elements or transducers are individually supported along a line of printing. Dependent upon the printer type, the horizontally-aligned, single element print heads may be either horizontally or vertically oriented in the axial direction for printing operation. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the case of a wire matrix printer which is utilized for form or multi-copy printing, the difference in thickness of the forms or copies may require some means or mechanism for adjusting the gap or the distance between the print head and the printer platen. It is in the field of business forms or like record media of different thicknesses that the subject matter of the present invention is most closely associated and which provides for improved and advantageous positioning and control of such forms during the printing operation. It is desirable that a positive method of forms compensation be provided regardless of the thickness of the form.

Representative documentation in the field of wire matrix print heads used for printing forms or like record media includes U.S. Pat. No. 3,776,341, issued to R. G. Dobner on Dec. 4, 1973, which discloses paper guide means that compensates for thickness of a document pack and wherein a front paper guide defines a normal gap and a spring loaded rear paper guide serves to compress the document pack.

U.S. Pat. No. 3,837,461, issued to H. K. Waibel on Sept. 24, 1974, discloses a platen assembly for feeding and holding single or multi-layer record media wherein the platen and the pressure roller are spring urged into engagement with the form by a pressure arm or block and the form is urged against gap guide means in the form of gap shoes on each side of the print head, and the form is held by the platen and the pressure and feed rollers during the printing operation.

U.S. Pat. No. 3,868,008, issued to P. A. Brumbaugh on Feb. 25, 1975, discloses printing station apparatus for a bank passbook type document including a resilient platen pivotally supported by bell cranks from an arm assembly. One solenoid rotates first camming means for moving the platen relative to a print element and another solenoid operates second camming means for maintaining the platen in position.

U.S. Pat. No. 3,912,068, issued to O. Kwan et al. on Oct. 14, 1975, discloses a printer having a document thickness compensating device wherein the spring-mounted platen is moved into position to clamp the document with substantially uniform pressure against elongated surfaces, and a document holding assembly includes a slot with control of document movement to position the document for printing.

U.S. Pat. No. 3,935,936, issued to R. H. Wilczewski on Feb. 3, 1976, discloses media thickness compensation means wherein the print head is biased in selective manner against a multi-faced rotatable stop member associated with a print head carried roller.

U.S. Pat. No. 4,024,940, issued to W. Hendrischk et al. on May 24, 1977, discloses a matrix printer having a document thickness compensating device wherein a roller on the print head runs on a resilient rail urged against the platen and the roller can be retracted by pivoting the rail carrier under engagement of a second rail cooperating with a second roller on the head.

U.S. Pat. No. 4,056,183, issued to J. Beery on Nov. 1, 1977, discloses a platen and a feed control roller shiftable by a solenoid between a retracted position and a print position U.S. Pat. No. 4,143,977, issued to T. Kurihara on Mar. 13, 1979, discloses first and second independently movable platen units arranged to compensate for recording medium thickness, a third platen unit between the first and second units, and first and second springs secured to the first and second units and biasing the third unit toward the print station.

U.S. Pat. No. 4,145,146, issued to Y. Ohkawara et al. on Mar. 20, 1979, discloses a web feeding mechanism and a reel driving mechanism operated through coupling means by spring means.

U.S. Pat. No. 4,184,780, issued to T. Kurihara et al. on Jan. 22, 1980, discloses a printer having a platen with separate units movable toward and away from the recording medium by rotary cams and spring means and lockable in position by lever means.

U.S. Pat. No. 4,210,076, issued to T. Yamamoto et al. on July 1, 1980, discloses printing apparatus with a type carrier movable on a tiltable support structure, position retaining means for the structure, clearance adjusting means depending upon printing medium thickness and cam means providing intervention between the retaining means and the adjusting means.

U.S. Pat. No. 4,222,673, issued to M. G. Plaza et al. on Sept. 16, 1980, discloses a print head carriage having a rotatable manifold member operating in eccentric camming manner to adjust the distance between the print head and the platen for accommodating printing media of various thicknesses.

U.S. Pat. No. 4,227,819, issued to R. F. Manriquez on Oct. 14, 1980, discloses a platen assembly for feeding and holding single or multi-layer record media and having one of a pair of feed rollers pivotally mounted to yieldingly engage and hold both sides of the record media while the platen yieldingly engages and holds the record media against gap determining guides. The platen is free floating with the aid of a pair of coil springs and is raised into engagement with the record media by rotatable cam means.

U.S. Pat. No. 4,233,895, issued to H. Wehler on Nov. 18, 1980, discloses a print head which is adjustable relative to the record media by means of complementary cam members and spring-urged cam followers operably associated with an electric motor.

U.S. Pat. No. 4,390,292, issued to H. M. Krenz on June 28, 1983, discloses bracket adjusting means for moving the print head relative to the platen for print media of different thicknesses.

U.S. Pat. No. 4,422,782, issued to R. L. Lawter et al. on Dec. 27, 1983, discloses a record member feed and support mechanism wherein a control solenoid moves record member drive rollers and a spring urged platen member. Force on the platen compensates for thickness of the record member and spring means are associated with the drive rollers to hold the record member in position.

U.S. Pat. No. 4,439,051, issued to R. L. Lawter on Mar. 27, 1984, discloses a rotatable platen carried on a pivoted arm and including solenoid means with spring loading for multi-form documents.

And, U.S. Pat. No. 4,514,101, issued to H. E. Smith on Apr. 30, 1985, discloses paper thickness adjusting mechanism including a pair of guide rails and an adjustable marking module movable along the rails. The mechanism uses a toggle bracket to allow the module to pivot about the guide rail relative to the platen.

SUMMARY OF THE INVENTION

The present invention relates generally to impact type printers which have the capability of printing on record media of different thicknesses. More particularly, the present invention relates to means for positioning the printer platen and an associated media drive roller in a manner to compensate for the difference in thickness of several types of record media being used in the printer. The record media may be a single layer sheet or a variety of multilayer forms, any of which may be of different or greater thickness than other media.

A media thickness compensating arm assembly is pivoted from a predetermined position relative to the printing station for supporting the printer platen so as to enable moving the platen in a direction toward and away from the print head. A solenoid-operated cam line, operably associated with and forming a part of the overall compensating assembly, is caused to be rotated in one direction to allow insertion of the form or like media in the gap between the platen and the print head, and the cam line is then caused to be rotated in the other direction to position the platen and the form for printing operation.

A second cam line is operably associated and connected with the first mentioned solenoid-operated cam line wherein the second cam line is rotated to hold the platen and the form in position during the printing operation. The platen is resiliently supported and the second cam line utilizes the benefit of over-centering means engageable with the platen for retaining and holding same in printing position More specifically, a second arm assembly including a record media drive or feed roller is interconnected with the forms compensating arm assembly through the use of pivot pins operating in a slot and located at a position between the platen and the media drive roller so as to provide a one-to-one ratio between the pressure-drive roller gap and the print head-platen gap. The second arm assembly is pivoted from a predetermined position relative to the printing station for supporting the media feed roller so as to enable moving the feed roller toward and away from the pressure roller.

In view of the above discussion, the principal object of the present invention is to provide mechanism in a printer for compensating different thicknesses of record media.

Another object of the present invention is to provide camming means rotatable in a manner to enable insertion of record media of different thicknesses.

An additional object of the present invention is to provide mechanism for adjusting the gap for record media inserted between the platen and the print head.

A further object of the present invention is to provide first camming means rotatable to accommodate record media of different thicknesses at a printing station and second camming means for holding the record media in position during printing operation.

Still another object of the present invention is to provide a first supporting member for the platen to effect a gap with the print head and to provide a second supporting member for the media feed roller to effect a gap with the media pressure roller which is substantially equal to the first mentioned gap.

Additional advantages and features of the present invention will become apparent and fully understood from a reading of the following description taken together with the annexed drawing.

DESCRIPTION OF THE PREFERRED EMBODIMENT

Prior to describing the structure in detail, it should be noted that the printer, for use in certain operations and/or environments, may be termed a form or slip printer in that the form or like record media is normally thicker than a single sheet of paper, or it may include a plurality of sheets making up a multiple-part form. It should be further noted that the present printer includes much of the structure and certain of the features described and shown in the above-referenced U.S. Pat. No. 4,575,267.

Figure 1:
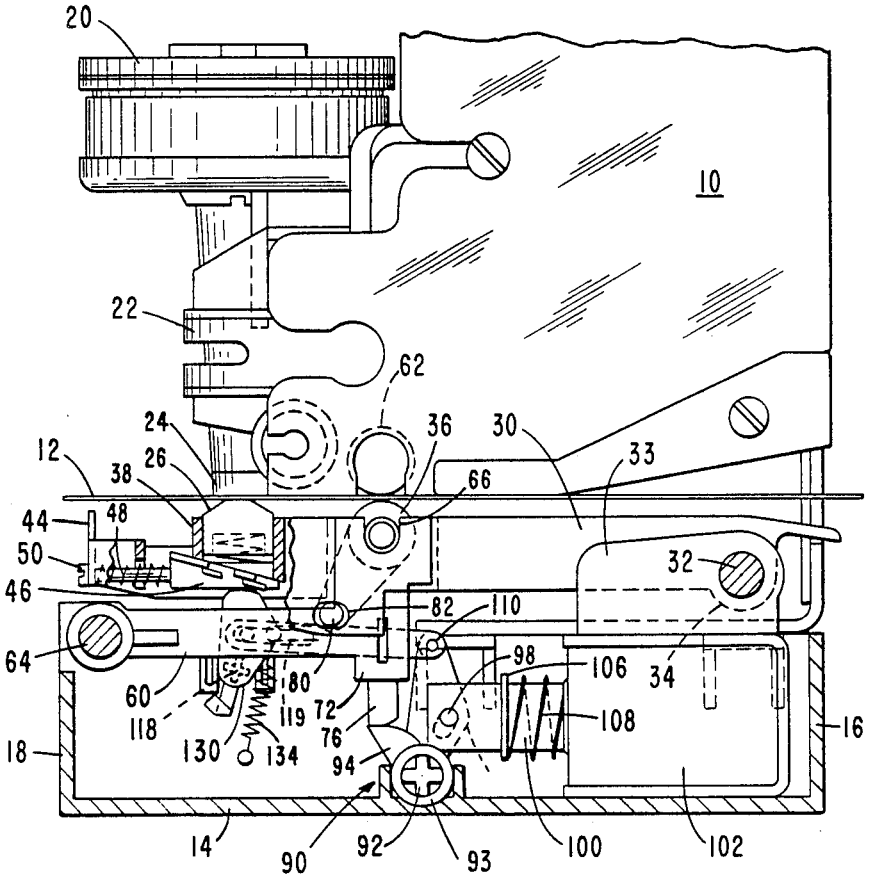
FIG. 1 is an elevational view of a printer, partly in section, incorporating the subject matter of the present invention and illustrating the parts in a printing position.

Referring now to FIG. 1, there is shown an elevational view of a printer, generally designated as 10, and as viewed from the front thereof by an operator, and oriented for operation in horizontal manner, wherein record media in the nature of a business form 12 enters in a direction from the right side. While the printer 10 of FIG. 1 is illustrated for form or slip printing operation it is understood, of course, that the subject matter of the present invention may likewise be utilized in an arrangement, wherein thick paper or multi-layer paper may be supplied from a paper roll (not shown) and placed in like orientation for printing thereon.

A frame member 14 serves as a base for the printer and has a first or angled portion 16, and a second portion 18 wherein the first portion provides a right wall and the second portion provides a left wall, the overall structure forming a bucket type frame for the various parts. It is noted at the outset that the main frame structure is made of plastic which may be of clear material and may be molded in one piece. As an example, the frame member portions 14, 16 and 18 are molded in one piece and may be formed for access to certain of the interior parts of the printer. A front wall and a rear wall (both not shown) complete the housing for the lower portion of the printer 10.

The printing mechanism utilizes a dot matrix print head 20 of well-known type which is suitably supported from a carriage 22 for reciprocal motion (in the direction of viewing) in printing operation. The operating end 24 of the print head is positioned in opposed manner relative to a platen 26 supported in horizontal manner from the printer.

The printer 10 includes a forms compensating assembly wherein a support structure or member 30, in the nature of a first or forms compensating arm, is pivotable on a forms compensating arm shaft 32 journaled in a cantilever-type bracket 33 (FIG. 1) connected to suitable side frame members of the printer. The support member or arm 30 is preferably molded in a single piece and includes bearing portions, as at 34, forming journals for the shaft 32. The support arm 30 is pivoted at shaft 32 and extends toward the left in FIG. 1. A feed roller 36 is supported from the front and rear walls of the printer 10. The support arm 30 has an end portion or trough 38 (FIG. 1) for housing the platen 26. A pair of coil springs, as at 40 (FIG. 2), are placed against one surface of the trough 38, one spring at each end thereof and resiliently support the flat metal platen 26. The platen 26 is adjusted by means of two screws and lock nuts (not shown) at the ends of the platen, which screws are located perpendicular to and pass through the platen into holes (not shown) located in the support arm 30. The lock nuts are justified to the underside of the support arm 30.

The support arm 30 further includes a generally square end portion, as at 44, (FIG. 1) which extends substantially the length of the trough 38 and supports a pair of latching camshaft adjusting ramps, as at 46, such ramps being fitted with the trough and movable thereunder. The ramps 46 are adjustably moved by means of a spring 48 and screw 50 arrangement to provide a means for adjusting an initial locking torque between a latching camshaft assembly (later described) and the flat area just below the trough portion 38 of the forms compensating arm 30 which supports the platen 26. The entire forms compensating arm assembly 30 swings about the shaft 32.

Figure 2:
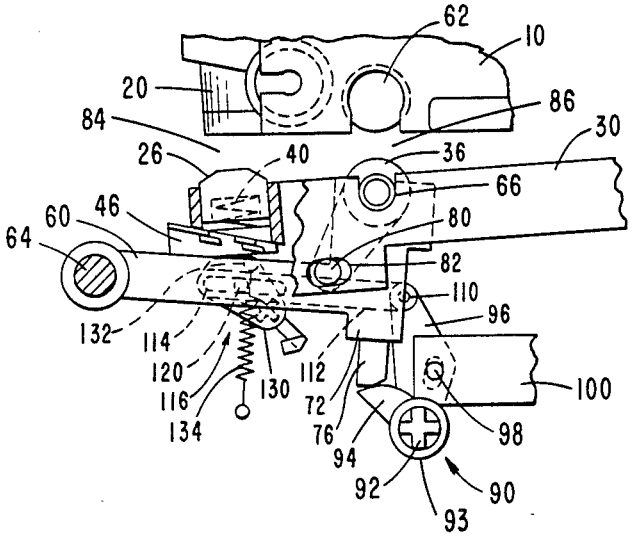
FIG. 2 is a view of certain mechanism within the printer of FIG. 1 and showing such mechanism in a non-printing position.

A second supporting arm assembly, generally indicated as 60, see also FIG. 2, is provided to effect difference or variation in the gap between the feed roller 36 and an associated pressure roller 62. The arm assembly 60 is pivoted on a shaft 64 journaled in the printer frame and provides suitable bearing blocks or supports, as at 66, for the feed roller 36. The entire feed roller arm assembly 60 swings about the shaft 64.

A pair of cylindrically-shaped members, as at 72, are formed integral with the arm assembly 60 and each of the members 72 contains a spring therein (not shown) for biasing a pin or plunger 76 in a downward direction.

The first supporting arm assembly 30 and the second arm assembly 60 are interconnected at a point between the area of contact between the feed roller 36 and the pressure roller 62 and the area of contact between the platen 26 and the print head 20, by means of a lost motion-type connection formed by a pin 80 and slot 82 arrangement. The slots 82 are formed or molded into the arm assembly 30 and the pins 80 are molded on the arm assembly 60. The adjusting ramps 46, the arm assembly 30 and the arm assembly 60 are interconnected by means of the pin 80-slot 82 arrangement. The location of these pins 80 and slots 82 in conjunction with the length of each of the arms 30 and 60 creates a one-to-one ratio of the gap or opening 84 (FIG. 2) between the platen 26 and the print head portion 24 and the gap or opening 86 between the feed roller 36 and the pressure roller 62.

A forms compensating camshaft assembly, generally designated as 90, (FIG. 1) is operably associated with the arm assembly 60 and includes an irregular or X-shaped cross-section shaft 92 suitably journaled at the ends thereof, as in bearings 93, placed into the frame portion 14 of the printer 10. The shaft 92 includes a pair of cam lobes, as at 94, which may be formed by use of polynomial expression and which are positioned to engage with the springurged pins or plungers 76 captured within the cylindrical members 72. A centrally-located, integrally formed link member 96 of the shaft 92 is connected by means of a clevis pin 98 carried by an armature or plunger 100 of a latching solenoid 102 suitably secured to or supported from the frame portion 14 of the printer 10. The solenoid armature 100 is loaded in one direction for return travel by a coil spring 108 operating against a washer 106.

The centrally-located link member 96 is pivotally connected at pivot 110 to a link 112 (FIG. 2) having slots, as at 114 in the sides thereof for slidably connecting with a second cam assembly, generally designated as 116. The cam assembly 116 includes an irregular or X-shaped cross-section shaft 118 (FIG. 1) which is suitably journaled in a portion of the printer frame. The shaft 118 for the cam assembly 116 has a double-sided member 119 as an integral portion at the center thereof with pins, as at 120, slidable in a lost motion-type connection with the slots 114 in the link 112. The shaft for the cam assembly 116 also includes at each end thereof a multi-sided plate-like member 130 as an integral part thereof and extending generally in an up and down direction under the ramps 46 supporting the platen 26. Each of the members 130 has a small projection, as at 132 (FIG. 2), extending outwardly beyond the ends of the cam assembly shaft, and a coil spring 134 is connected to each projection and to an appropriate anchor in the frame portion 14 of the printer 10 to provide a rotational bias on the plate members 130. Further, the spring 134 biases the shaft 118 along with the member 130 in an over-center position or condition, as illustrated in FIG. 1.

In the operation of the forms compensating mechanism of the present invention, it is desirable that the mechanism accommodate record media of different thicknesses and also provide a firm support for the media during the printing operation. In this regard, the thickness of the record media 12 determines the gap or opening 86 between the feed roller 36 and the pressure roller 62, and the gap or opening 84 between the platen 26 and the print head 20, which gaps are substantially equal as provided by the shown and described structure.

In FIG. 1, which illustrates the operating or printing position of the parts, the armature or plunger 100 is inward toward the solenoid 102 in a condition wherein the shaft 92 along with the cam lobes 94 are rotated in a clockwise direction through the clevis pin 98 connection of the armature 100 with the link member 112 which action moves such cam lobes 94 clockwise and raises the pins 76 along with the cylinders 72. The forms compensating arm assembly 30 and the feed roller arm assembly 60 are swung upwardly in clockwise and counterclockwise directions, respectively, to effect substantially the same gap between the pressure roller 62 and the feed roller 36 and also between the platen 26 and the tip 24 of the print head 20 for entry of the record media 12. While the initial gap between the platen 26 and the print head 20 is set without any media between the pressure roller 62 and the feed roller 36, the forms compensating mechanism will automatically maintain the same gap therebetween for different thicknesses of the various media. Depending upon the thickness of the media, the spring-loaded pins or plungers 76 in cylindrical members 72 are lowered to provide or apply the proper loading between the feed roller 36 and the pressure roller 62 for smoothly advancing the media 12 to the printing station.

When the form or other media 12 is in position for printing thereon, the solenoid 102 is energized and the armature or plunger 100 is retracted or moved to the right, as illustrated in FIG. 1. The camshaft assembly 90 is rotated in the clockwise direction and such motion causes engagement of the cam lobes 94 on the shaft 92 with the spring-loaded pins 76 and swings the forms compensating arm assembly 30 along with the platen 26 toward the print head 20, and the feed roller arm assembly 60 along with the feed roller 36 toward the pressure roller 62. When the solenoid 102 is energized, the camshaft assembly 90 is rotated into position, and at the same time, the solenoid is latched and power is turned off. The solenoid 102 includes a pull coil and a return coil in its circuitry for proper operation. When the camshaft assembly 90 is rotated, the forms compensating arm assembly 30 and the feed roller arm assembly 60 are swung upwardly until contact is made between the feed roller 36 and the pressure roller 62. The forms compensating camshaft assembly 90 continues to rotate until the solenoid plunger bottoms. To compensate for additional travel required by the camshaft 92, the plungers 76 are pushed upwardly into the members 72 and apply the required load between the feed roller 36 and the pressure roller 62 on the media 12. The link 112 connecting the first camshaft 92 and the second or latching camshaft 118 is moved by the member 96 and causes the second camshaft to be rotated to an overcenter position, as seen in FIG. 1 relative to the position shown in FIG. 2, and as set and held by the springs 134. In this manner, the members 130 at the ends of the latching camshaft 118 are rotated to tightly engage with the adjusting ramps 46 mounted in arm 30 and thusly provide a firm base or support for the printing operation.

As briefly alluded to earlier, FIG. 1 is a view illustrating a horizontal orientation of the forms compensating mechanism. This view shows the pivot shaft 32 along with the camshaft 92 for carrying the cam lobes 94 at the ends thereof and for engaging with the pins 76 of the cylindrical members 72 for raising the platen 26 and feed roller 36 assemblies upon energization of the solenoid 102. Further, FIG. 1 shows the second or latching camshaft 118 with the plate members 130 at the ends thereof for engaging with the underside of the ramps 46 supporting the arm 30.

FIG. 2 shows the open position of and the gap 84 between the platen 26 and the print head 20, and the open position of and the gap 86 between the feed roller 36 and the pressure roller 62, and wherein the camshaft assembly 90 and the camshaft assembly 116 are rotated in a counter-clockwise position. The entire mechanism is returned to such open position when a voltage is applied to the return coil of the solenoid, thereby neutralizing the magnets in the solenoid 102.

It is thus seen that herein shown and described is a record media thickness compensating mechanism which provides first camming means rotatable to accommodate record media and second camming means for providing firm support of the several parts for the printing operation. The support arm assembly for the media drive roller and the support arm assembly for the platen are interconnected by a lost motion connection to provide a one-to-one gap ratio and thereby effect a substantially equal opening at spaced locations. The mechanism requires only two adjustments for operation, such being the initial platen-print head gap setting and the latching camshaft to adjust the ramp setting. The mechanism and arrangement enable the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

We claim:

1. Record media thickness compensating mechanism for use in a printer having an operating print head, the mechanism comprising a first arm assembly pivotally supported from the printer and carrying a platen opposite the print head, first camming means pivotally supported from the printer and operably associated with the first arm assembly, means for rotating the first camming means for moving the platen toward and away from the print head during respective printing and non-printing conditions, second camming means pivotally supported from the printer, a second arm assembly pivotally supported from the printer and carrying a record media feed roller opposite a pressure roller for advancing record media and for providing a gap between the feed roller and the pressure roller, linkage means comprising a lost motion type arrangement operably connecting the first arm assembly and the second arm assembly for providing a gap between the print head and the platen that is substantially equal to the gap between the pressure roller and the feed roller, and means operably associated with the first and second camming means for maintaining the platen in position during printing operation.

2. The mechanism of claim 1 wherein the first arm assembly includes means at multiple locations thereof for resiliently supporting the platen.

3. The mechanism of claim 1 wherein the first arm assembly includes an end portion and a plurality of angle members engaging the ends of the end portion for supporting the platen.

4. The mechanism of claim 1 wherein the second arm assembly includes a plurality of captured members engageable with the first camming means.

5. The mechanism of claim 1 wherein the first camming means includes spaced cam members engageable with the second arm assembly.

6. The mechanism of claim 1 wherein the rotating means comprises a solenoid connected with the first camming means and operable for rotation to move the platen toward the print head.

7. The mechanism of claim 1 wherein the linkage means comprises a pin and slot arrangement connecting the first arm assembly and the second arm assembly and operable to rotate the second camming means after rotation of the first camming means.

8. The mechanism of claim 1 wherein the second camming means includes spaced cam members for rotating and rotating the first arm assembly and maintaining the position thereof during printing operation.

9. The mechanism of claim 1 wherein the first camming means comprises a shaft having spaced cam portions integral therewith and the second arm assembly includes cylindrically-shaped portions integral therewith and which portions include plungers captured therein and engageable with the spaced cam portions on the shaft.

10. A printer having a print head and an opposed platen movable relative to the print head, means for advancing record media past a printing station formed by the print head and the platen, and means for compensating for different thicknesses of record media comprising a first support assembly carrying the platen and pivotally connected with the printer, a first cam member journaled from the printer and operably associated with the first support assembly, a second cam member operably associated with the first cam member to be rotated thereby, a second support assembly carrying a record media feed roller opposite a record media pressure roller for advancing the record media and providing a gap between the feed roller and the pressure roller, linkage means comprising a lost motion type arrangement operably connecting the first support assembly and the second support assembly for providing a gap between the print head and the platen that is substantially equal to the gap between the pressure roller and the feed roller, and means for rotating the first cam member for moving the platen and the record media into position relative to the print head and then rotating the second cam member into engagement with the first support assembly for maintaining the position of the platen.

11. The printer of claim 10 wherein the first support assembly includes means for resiliently supporting the platen.

12. The printer of claim 10 wherein the means for advancing the record media comprise the feed roller spaced from the pressure roller, and the second support assembly includes an arm member with spaced portions thereon for journaling the feed roller.

13. The printer of claim 10 wherein the second support assembly includes an arm member with spaced cylindrical portions thereon enclosing plunger members engageable with the first cam member.

14. The printer of claim 10 wherein the first cam member includes spaced projections thereon engageable with the first support assembly.

15. The printer of claim 10 wherein the first cam member comprises a shaft having a projection thereon and the second cam member comprises a shaft having a projection thereon aligned with the first cam member projection and the linkage means comprises a pin and slot arrangement connecting the projections whereby rotation of the first shaft for moving the platen into position is followed by rotation of the second shaft for maintaining the platen position.

16. The printer of claim 10 wherein said second cam member comprises a shaft supported and journaled from the printer and includes spaced cam portions and springs connecting the printer and the cam portions for effecting an over-center condition of the cam portions when the second cam member is rotated into position against the first support assembly.

17. In a printer having a print head movable along a platen at a line of printing, drive and driven means for advancing record media past the line of printing, a first support assembly carrying the platen and pivotable to move the platen toward the print head, the improvement comprising a first cam member journaled in the frame of the printer and rotatable to effect swinging movement of the first support assembly, a second cam member journaled on the printer, a second support assembly carrying the record media drive means and providing a gap between the drive means and the driven means, linkage means comprising a lost motion type arrangement operably connecting the first support assembly and the second support assembly for providing a gap between the print head and the platen that is substantially equal to the gap between the drive means and the driven means, and means operably connected with the first cam member whereby rotation of the first cam member moves the platen along with the record media into printing position and then rotation of the second cam member maintains the platen and record media in the printing position.

18. In the printer of claim 17 wherein the second support assembly includes spaced cylindrically-shaped projections thereon containing spring-loaded members therein for engaging with the first cam member upon rotation thereof.

19. In the printer of claim 17 wherein the second cam member includes spaced projections thereon and engageable with the first support assembly to maintain the platen and the record media in printing position.

20. In the printer of claim 17 wherein the linkage means connecting the first support assembly and the second support assembly is a pin and slot arrangement whereby the second cam member is rotated after rotation of the first cam member.

* * * * *

UNITED STATES PATENT AND TRADEMARK OFFICE

CERTIFICATE OF CORRECTION

PATENT NO. : 4,632,577

DATED : December 30, 1986

INVENTOR(S) : Robert A. Brull et al.

It is certified that error appears in the above—identified patent and that said Letters Patent is hereby corrected as shown below:

Column 10, Lines 4 and 5, delete the words "rotating and rotating" and substitute --engaging--.

Signed and Sealed this

Fourteenth Day of April, 1987

*Attest:*

DONALD J. QUIGG

*Attesting Officer*

*Commissioner of Patents and Trademarks*